US011597412B2

(12) United States Patent
Ikemoto

(10) Patent No.: US 11,597,412 B2
(45) Date of Patent: Mar. 7, 2023

(54) CASING FOR RAILROAD VEHICLE DEVICE

(71) Applicant: Mitsubishi Electric Corporation, Tokyo (JP)

(72) Inventor: Minoru Ikemoto, Tokyo (JP)

(73) Assignee: MITSUBISHI ELECTRIC CORPORATION, Chiyoda-Ku (JP)

( * ) Notice: Subject to any disclaimer, the term of this patent is extended or adjusted under 35 U.S.C. 154(b) by 459 days.

(21) Appl. No.: 16/757,551

(22) PCT Filed: Oct. 27, 2017

(86) PCT No.: PCT/JP2017/038918
§ 371 (c)(1),
(2) Date: Apr. 20, 2020

(87) PCT Pub. No.: WO2019/082379
PCT Pub. Date: May 2, 2019

(65) Prior Publication Data

US 2021/0163046 A1 Jun. 3, 2021

(51) Int. Cl.
*B61F 1/14* (2006.01)
*B61C 17/12* (2006.01)

(52) U.S. Cl.
CPC ..... *B61C 17/12* (2013.01); *B61F 1/14* (2013.01)

(58) Field of Classification Search
CPC ..... B61F 1/14
See application file for complete search history.

(56) References Cited

U.S. PATENT DOCUMENTS 2,527,221 A * 10/1950 Huye ..... B65D 5/48024 229/120.33
2,541,846 A * 2/1951 Ullrich ..... B65D 9/38 220/640

(Continued)

FOREIGN PATENT DOCUMENTS

DE 102013110637 A1 * 3/2015 ..... B61C 17/00
DE 102013110637 A1 3/2015

(Continued)

OTHER PUBLICATIONS

Chinese Office Action dated Dec. 28, 2020 issued by the Chinese Patent Office in corresponding Chinese Patent Application No. 201780096170.6, with partial English translation (11 pages).

(Continued)

*Primary Examiner* — Scott A Browne
(74) *Attorney, Agent, or Firm* — Buchanan Ingersoll & Rooney PC

(57) ABSTRACT

A housing of a railway vehicle device includes a reinforcing member and at least one first exterior member. The reinforcing member includes a first support member extending in a X-axis direction, and second support members that are fixed to the first support member while main surfaces are oriented in a direction intersecting the X-axis direction, the second support members being plate-like members. The first exterior members are thin plate-like members that are fixed to side surfaces of the second support members, cover a periphery of the reinforcing member, and form housing surfaces extending along the X-axis direction. In each of the first exterior members, cutouts each are formed extending in a direction intersecting the X-axis direction from the both ends in the direction intersecting the X-axis direction. An opening is formed, by the cutouts, in at least one of the housing surfaces extending along the X-axis direction.

20 Claims, 7 Drawing Sheets

(56) References Cited

U.S. PATENT DOCUMENTS

| | | | | |
|---|---|---|---|---|
| 3,966,285 | A * | 6/1976 | Porch | B65D 7/24 312/263 |
| 5,327,262 | A * | 7/1994 | Williams | H04N 1/40062 358/530 |
| 5,369,549 | A * | 11/1994 | Kopp | H05K 5/0221 361/679.01 |
| 6,293,637 | B1 * | 9/2001 | Anderson | H02B 1/54 312/265.4 |
| 6,616,251 | B2 * | 9/2003 | Searby | G06F 1/181 361/679.02 |
| 7,733,659 | B2 * | 6/2010 | Snider | H04B 1/082 361/752 |
| 2010/0116545 | A1 * | 5/2010 | Lewison | H05K 5/0021 29/428 |
| 2011/0002494 | A1 * | 1/2011 | Opitz | B22F 3/1125 381/334 |
| 2017/0105309 | A1 * | 4/2017 | Franklin | A47B 87/0276 |

FOREIGN PATENT DOCUMENTS

| | | | |
|---|---|---|---|
| EP | 3051931 | A1 * | 8/2016 |
| JP | 2002120720 | A | 4/2002 |
| JP | 4014794 | B2 * | 11/2007 |
| JP | 2007326388 | A | 12/2007 |
| JP | 2008028160 | A | 2/2008 |
| JP | 2008105489 | A | 5/2008 |
| JP | 2009096460 | A | 5/2009 |

OTHER PUBLICATIONS

Office Action dated Nov. 25, 2021, in corresponding India Patent Application No. 202027016132, with English translation. (6 pages).

International Search Report (with English Translation) and Written Opinion issued in corresponding International Patent Application No. PCT/JP2017/038918, 8 pages (dated Nov. 28, 2017).

* cited by examiner

CASING FOR RAILROAD VEHICLE DEVICE

TECHNICAL FIELD

The present disclosure relates to a housing of a railway vehicle device to be attached to a railway vehicle.

BACKGROUND ART

A housing of a railway vehicle device to be installed on railway vehicle is formed by a plurality of members fixed to each other with fastening members. In a railway vehicle underfloor device disclosed in Patent Literature 1, the lower edge portion of front surface walls is fastened to a joint portion of a bottom wall via rivets to fasten the joint of a ceiling wall to the upper edge portion of the front surface walls.

CITATION LIST

Patent Literature

Patent Literature 1: Unexamined Japanese Patent Application Publication No. 2009-96460

SUMMARY OF INVENTION

Technical Problem

A housing of a railway vehicle device has a longitudinal-direction length larger than a longitudinal-direction length of, for example, a housing of a common industrial power conversion device. Similarly to the railway vehicle underfloor device disclosed in Patent Literature 1, when the rivets are riveted into the joints extending along a longitudinal direction, the number of rivets increases as the longitudinal-direction length of the housing of the railway vehicle device increases, and thus cost increases.

In consideration of the above circumstances, an objective of the present disclosure is manufacturing cost reduction of the railway vehicle device.

Solution to Problem

In order to attain the above objective, a housing of a railway vehicle device of the present disclosure is a housing of a railway vehicle device to be attached to a railway vehicle, and includes a reinforcing member and at least one first exterior member. The reinforcing member includes a first support member extending in a traveling direction of the railway vehicle, and second support members each being a plate-like member fixed to the first support member and having a main surface oriented in a direction intersecting the traveling direction. The at least one first exterior member covers a periphery of the reinforcing member, is fixed to side surfaces of the second support members, and forms housing surfaces extending along the traveling direction, and each area thin plate-like member. The at least one first exterior member has a cutout extending in a direction intersecting the traveling direction from at least one end of both ends in the direction intersecting the traveling direction. The cutout of the at least one first exterior member forms an opening at either one of the housing surfaces extending along the traveling direction.

Advantageous Effects of Invention

According to the present disclosure, providing of a reinforcing member including a first support member and a second support members fixed to the first support member and having main surfaces oriented in a direction intersecting the traveling direction, and at least one exterior member is fixed to side surfaces of the second support members to cover a periphery of the reinforcing member, enables reduction of a manufacturing cost of the railway vehicle device.

DESCRIPTION OF EMBODIMENTS

Embodiments according to the present disclosure are hereinafter described with reference to drawings. Note that in the figures, the same or similar components are denoted by the same reference sign.

Embodiment 1

Figure 1:
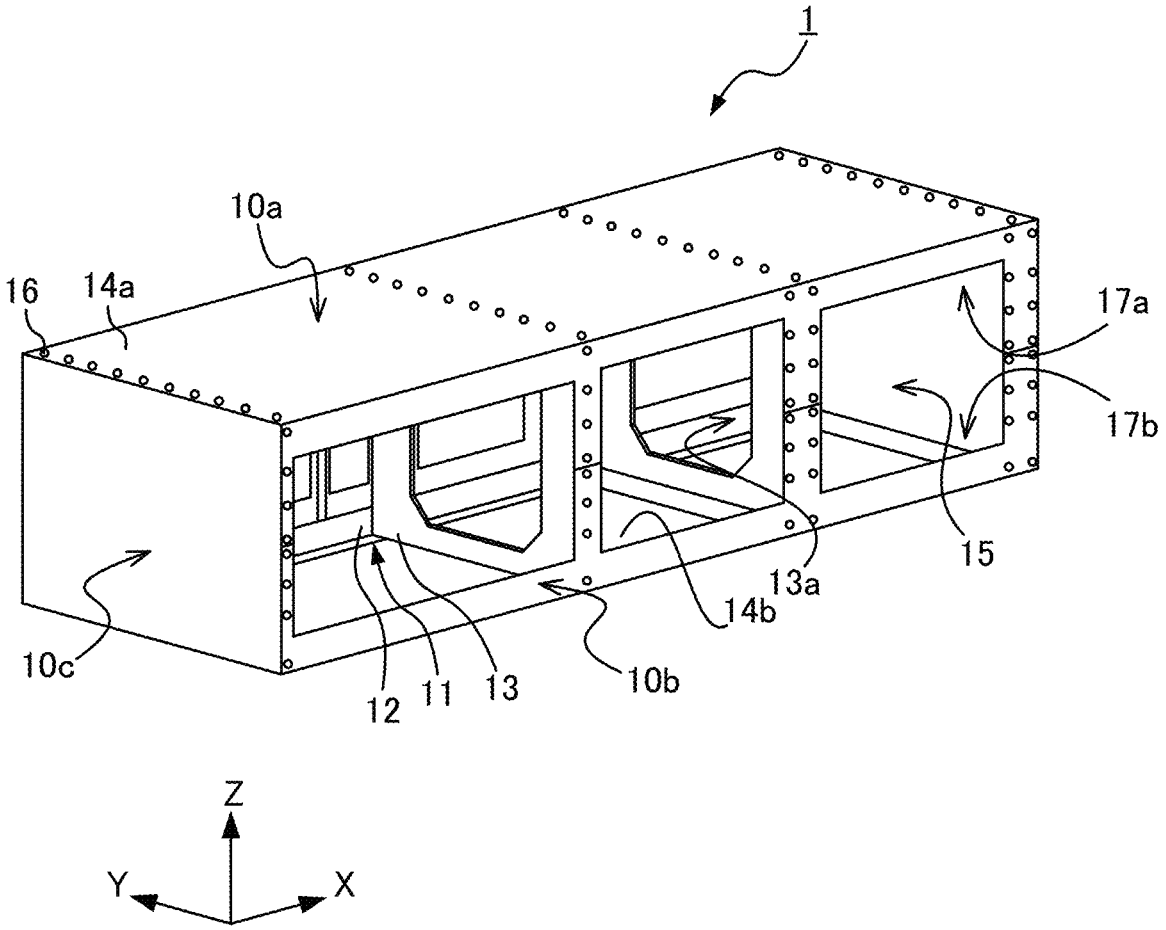
FIG. 1 is a perspective view of a housing of a railway vehicle device according to Embodiment 1 of the present disclosure.

FIG. 1 is a perspective view of a housing of a railway vehicle device according to Embodiment 1 of the present disclosure. The railway vehicle device is installed on, for example, an electric railway vehicle. The railway vehicle device is attached under a floor of the railway vehicle by, for example, non-illustrated suspension metal fittings. In FIG. 1, an X-axis direction is a traveling direction or front-rear direction of the railway vehicle. A Z-axis direction is a vertical direction or an upper-lower direction. A Y-axis direction is a direction orthogonal to an X-axis and a Z-axis, that is, a width direction or a right-to-left direction. Non-illustrated electronic components are stored in the interior of a housing 1 of the railway vehicle device. The housing 1 has an opening 15 for performance of maintenance of the electronic components. The housing 1 includes a reinforcing member 11 and at least one first exterior member 14*a*. The reinforcing member 11 includes a first support member 12 extending in the X-axis direction, and second support members 13 that are plate-like members each fixed to the first support member 12 while having a main surface oriented in a direction intersecting the X-axis direction. In an example of Embodiment 1, the second support members 13 each have the main surface orthogonal to the X-axis direction. Among the second support members 13, second support members 13, other than second support members 13 positioned at both ends in the X-axis direction, each have an opening 13*a* penetrating in the X-axis direction.

First exterior members 14*a* and 14*b* are thin plate-like members fixed to the side surfaces of the second support members 13 while covering a periphery of the reinforcing member 11 to form housing surfaces 10*a* and 10*b* of the housing 1 that extend along the X-axis direction. The side surfaces of the second support members 13 are surfaces orthogonal to the main surfaces of the respective second support members 13, that is, a surface parallel to the X-axis direction in an example of FIG. 1. The first exterior members 14*a* and 14*b* have respective cutouts 17*a* and 17*b* extending in a direction intersecting the X-axis direction from the both ends in a direction intersecting the X-axis direction. At least one of the housing surface 10*a* or the housing surface 10*b* extending along the X-axis direction has the opening 15 formed by the cutouts 17*a* and 17*b* of the respective first exterior members 14*a* and 14*b*. In the example of FIG. 1, among the housing surfaces 10*a* and 10*b* extending along the X-axis direction, two housing surfaces 10*b* facing each other in the Y-axis direction have openings 15. In the example of FIG. 1, the first exterior members 14*a* and 14*b* are fixed to the side surfaces of the second support members 13 by rivets 16. As the openings 15 become wider, widths of the first exterior members 14*a* and 14*b* in the X-axis direction decrease between openings 15, or the opening 15 and a housing surface 10*c*. Thus, although force acting on the first exterior members 14*a* and 14*b* increases between the openings 15, or the opening 15 and the housing surface 10*c*, the second support members 13 can bear the force because the first exterior members 14*a* and 14*b* are fixed to the second support members 13. Thus, even when the opening 15 increases, durability of the housing 1 can be secured. The method of fixing of the first exterior members 14*a* and 14*b* is not limited to use of the rivets 16, and the first exterior members 14*a* and 14*b* may be fixed to the side surfaces of the second support members 13 by welding.

Figure 2:
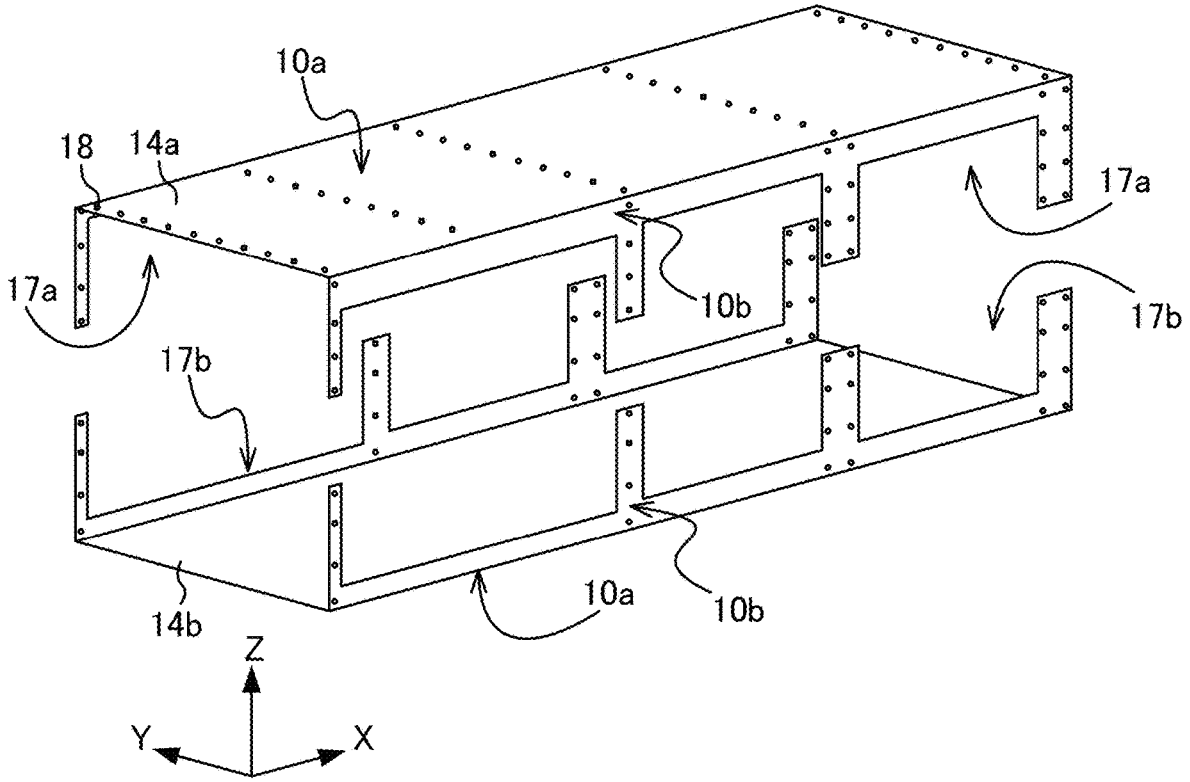
FIG. 2 is a perspective view of a first exterior member according to Embodiment 1.

FIG. 2 is a perspective view of the first exterior member according to Embodiment 1. In the example of Embodiment 1, the housing 1 includes two first exterior members 14*a* and 14*b* each having the rectangular main surfaces. The first exterior member 14*a* forms an upper housing surface 10*a*, among two housing surfaces 10*a* facing each other in the Z-axis direction, and parts of the two housing surfaces 10*b* facing each other in the Y-axis direction. The first exterior member 14*b* forms a lower housing surface 10*a*, among the two housing surfaces 10*a* facing each other in the Z-axis direction and parts of the two housing surfaces 10*b* facing each other in the Y-axis direction. The two first exterior members 14*a* and 14*b* have the respective cutouts 17*a* and 17*b* extending in a direction orthogonal to the X-axis direction from the both ends in a direction orthogonal to the X-axis direction, that is, from edges parallel to the X-axis direction. In an example of FIG. 2, the first exterior members 14*a* and 14*b* forming the housing surfaces 10*b* have the respective cutouts 17*a* and 17*b* extending in the Z-axis direction. In addition, in the example of FIG. 2, the both ends of the first exterior member 14*a* have respectively three cutouts 17*a*. Similarly, the both ends of the first exterior member 14*b* have respectively three cutouts 17*b*. In the example of FIG. 1, among the housing surfaces 10*a* and 10*b* extending along the X-axis direction, the housing surface 10*b* orthogonal to the Y-axis direction has openings 15 due to a formation of the cutouts 17*a* and 17*b*. The first exterior members 14*a* and 14*b* each have through holes 18 into which the rivets 16 are inserted. The first exterior members 14*a* and 14*b* are made of, for example, aluminum for weight reduction of the housing 1.

Figure 3:
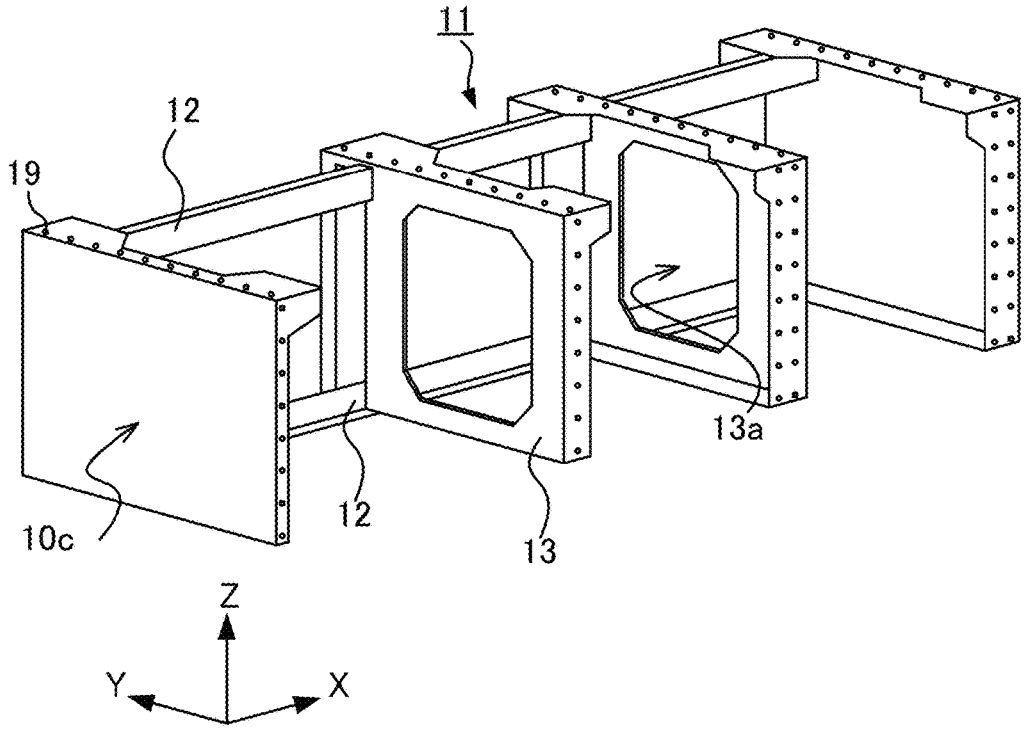
FIG. 3 is a perspective view of a reinforcing member according to Embodiment 1.

FIG. 3 is a perspective view of the reinforcing member according to Embodiment 1. The reinforcing member 11 is made of a member such as iron having a strength as may be required for the housing 1 to exhibit a desirable strength. The first support member 12 included in the reinforcing member 11 extends in the X-axis direction. In an example of FIG. 3, the second support members 13 included in the reinforcing member 11 each have a main surface oriented in a direction orthogonal to the X-axis direction and are fixed to the first support member 12. The method of fixing the second support members 13 to the first support member 12 can be freely selected. The second support members 13 have through holes 19 into which the rivets 16 are inserted. In the example of Embodiment 1, among the second support members 13, two second support members 13 positioned at the both ends in the X-axis direction form two housing surfaces 10*c* that face each other in the X-axis direction in the housing 1. In the example of FIG. 3, the housing surfaces 10*c* are orthogonal to the X-axis direction.

As described above, the first exterior members 14*a* and 14*b* are fixed to the side surfaces of the second support members 13. Since the first exterior members 14*a* and 14*b* facing each other are located around the opening 15, the number of rivets 16 to be arranged in alignment in a longitudinal direction and riveted as may be required for exterior members to be coupled to each other can be reduced, and thus the number of rivets 16 can be reduced compared to the case in which the rivets 16 are arranged in alignment in the longitudinal direction and riveted. As a result, manufacturing cost of the housing 1 can be reduced. The interval between the rivets 16 may be determined so that the first exterior members 14*a* and 14*b* do not move relative to the second support members 13.

As described above, according to the housing 1 of Embodiment 1, the use of the reinforcing member 11 including the first support member 12 and the second support members 13, as well as at least one exterior member 14*a* or exterior member 14*b* that are fixed to the side surfaces of the second support members 13 to cover a periphery of the reinforcing member 11 enables reduction of the manufacturing cost of the railway vehicle control device.

Embodiment 2

Figure 4:
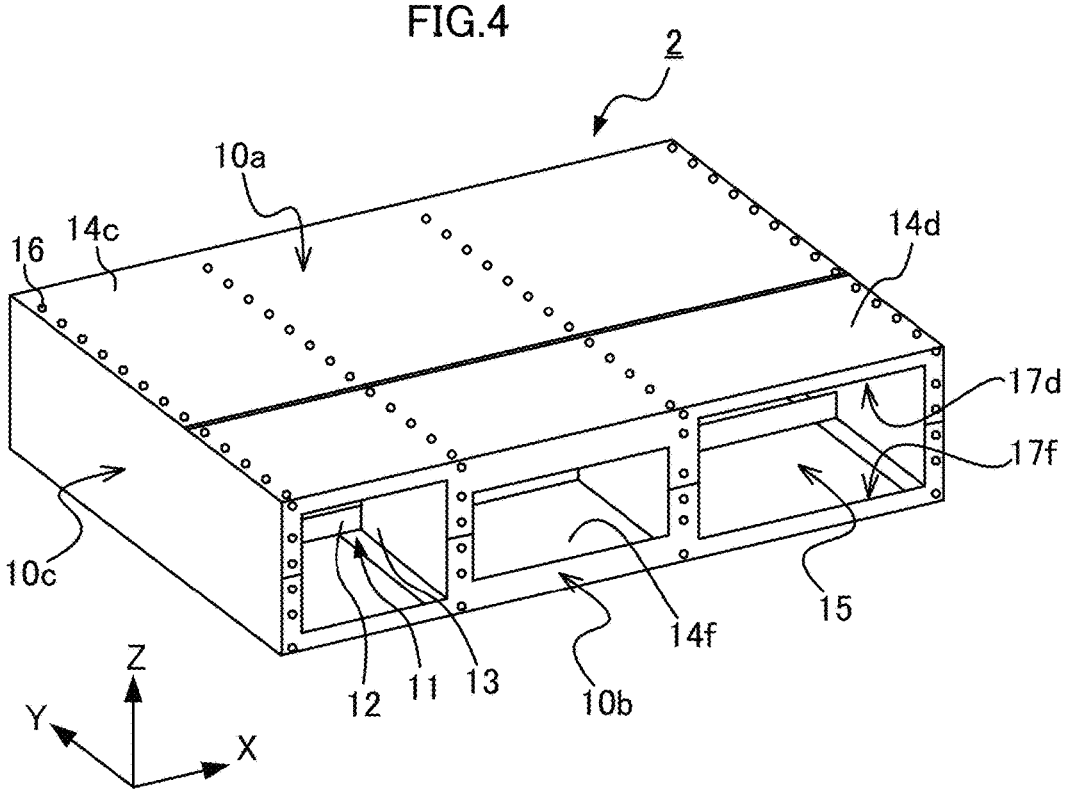
FIG. 4 is a perspective view of a housing of the railway vehicle device according to Embodiment 2 of the present disclosure.
Figure 5:
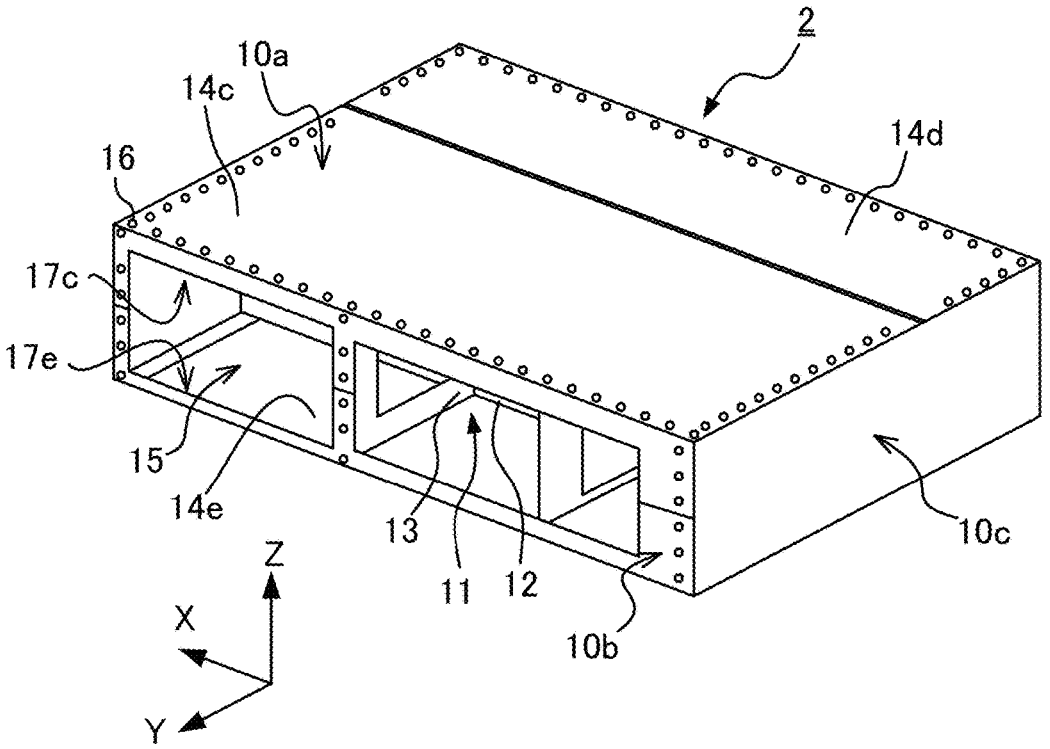
FIG. 5 is a perspective view of the housing of the railway vehicle device according to Embodiment 2.
Figure 6:
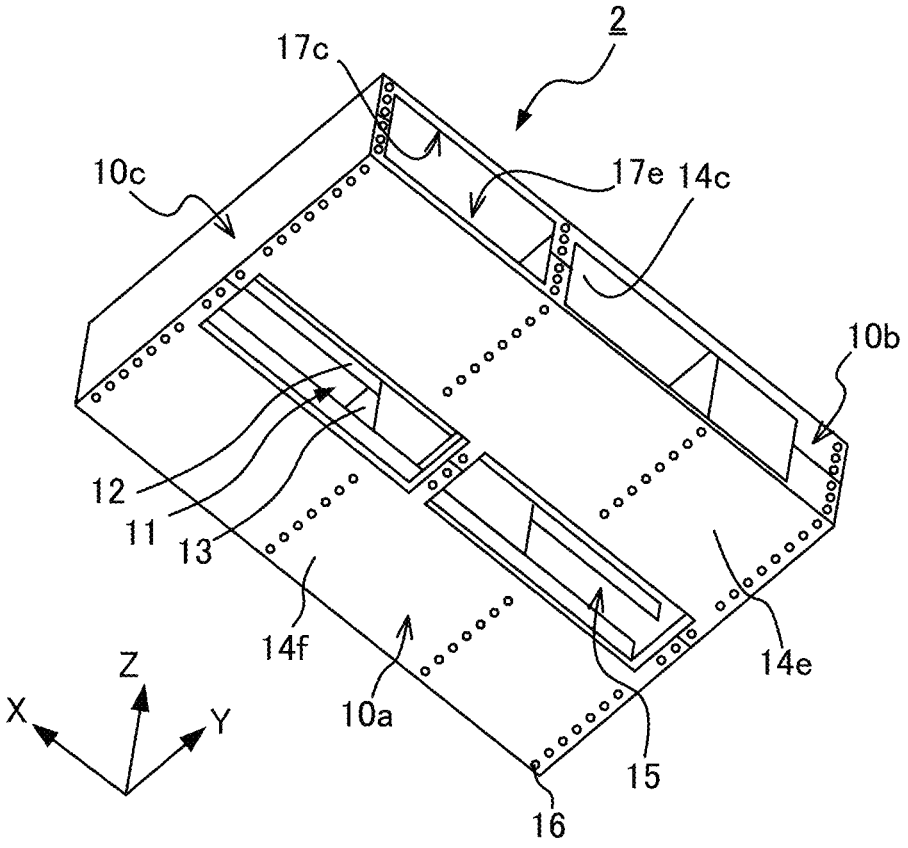
FIG. 6 is a perspective view of the housing of the railway vehicle device according to Embodiment 2.

FIGS. 4 to 6 are perspective views of a housing of the railway vehicle device according to Embodiment 2 of the present disclosure. FIG. 4 is a diagram when a housing 2 is viewed toward a positive direction of the Y-axis. FIG. 5 is a diagram when the housing 2 is viewed toward a negative direction of the Y-axis. FIG. 6 is a diagram when the housing 2 is viewed toward a positive direction of the Z-axis. Unlike the housing 1 of the railway vehicle device according to Embodiment 1, in examples of FIGS. 4 to 6, two housing surfaces 10*b* facing each other in the Y-axis direction, among the housing surfaces 10*a* and 10*b* extending along the X-axis direction, and lower housing surface 10*a*, among two housing surfaces 10*a* facing each other in the Z-axis direction, extending in the Z-axis direction, have the openings 15.

Figure 7:
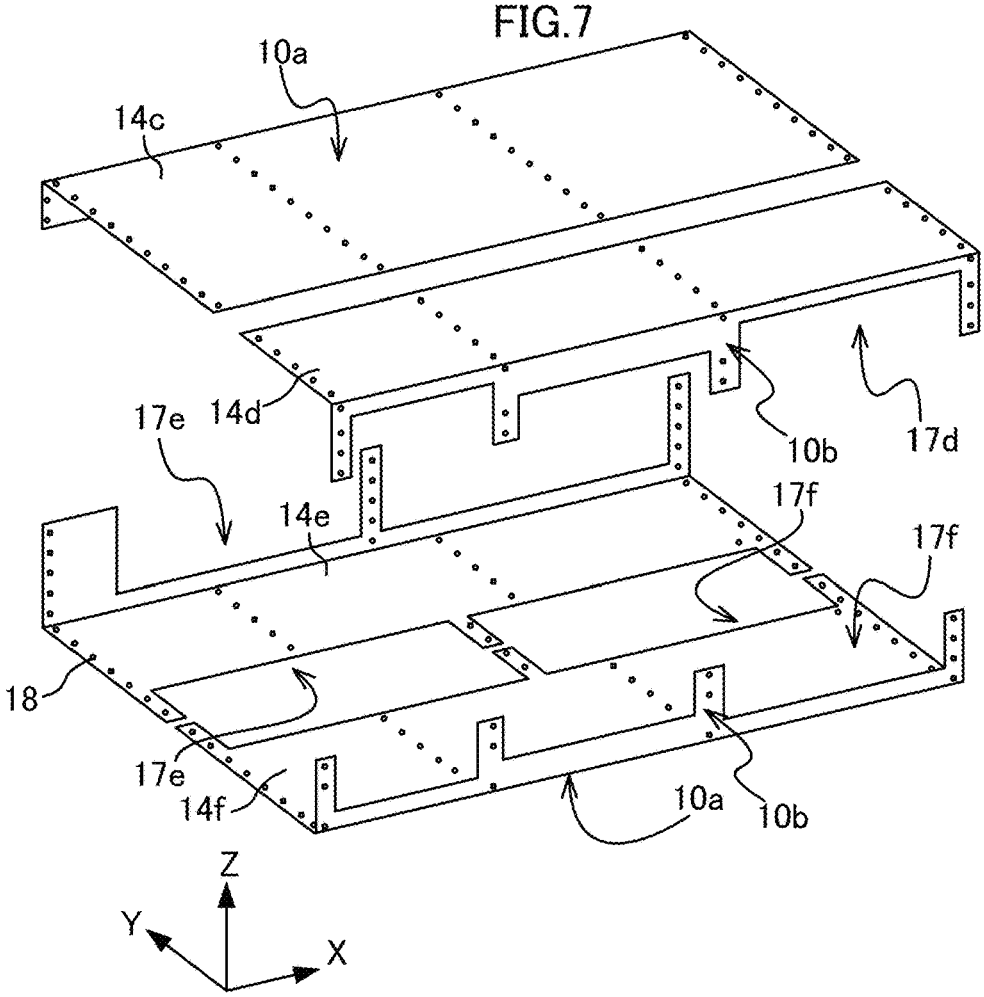
FIG. 7 is a perspective view of a first exterior member according to Embodiment 2.

FIG. 7 is a perspective view of a first exterior member according to Embodiment 2. In an example of Embodiment 2, the housing 2 includes four first exterior members 14*c*, 14*d*, 14*e*, and 14*f* each having a rectangular main surface. The first exterior members 14*c* and 14*d* form a part of an upper housing surface 10*a* in the Z-axis direction, among two housing surfaces 10*a* facing each other in the Z-axis direction, and a part of one of two housing surfaces 10*b* facing each other in the Y-axis direction. In the first exterior members 14*c* and 14*d*, cutouts 17*c* and 17*d* are formed respectively from the lower end of the first exterior members 14*c* and 14*d* in the Z-axis direction. The first exterior members 14*e* and 14*f* form a part of a lower housing surface 10*a* in the Z-axis direction, among two housing surfaces 10*a* facing each other in the Z-axis direction, and a part of one of two housing surfaces 10*b* facing each other in the Y-axis direction. In the first exterior members 14*e* and 14*f*, cutouts 17*e* and 17*f* extending in a direction orthogonal to the X-axis direction from the both ends in a direction orthogonal to the X-axis direction, that is, from the edges parallel to the X-axis direction. In an example of FIG. 7, the first exterior members 14*c*, 14*d*, 14*e*, and 14*f* forming the housing surfaces 10*b* have respective cutouts 17*c*, 17*d*, 17*e*, and 17*f* extending in the Z-axis direction. In addition, the first exterior members 14*e* and 14*f* forming the housing surfaces 10*a* have the respective cutouts 17*e* and 17*f* extending along the Y-axis direction. The lower housing surface 10*a* in the Z-axis direction, among two housing surfaces 10*a* facing to each other in the Z-axis direction, and two housing surfaces 10*b* facing each other in the Y-axis direction have the opening 15 formed by the cutouts 17*c*, 17*d*, 17*e*, and 17*f*.

Figure 8:
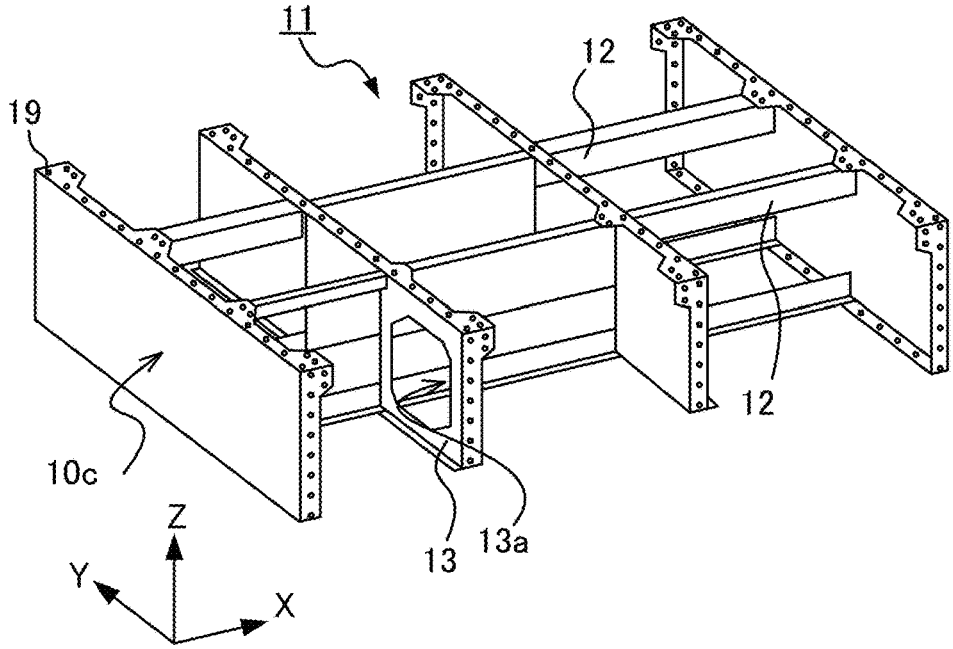
FIG. 8 is a perspective view of a reinforcing member according to Embodiment 2.

FIG. 8 is a perspective view of the reinforcing member according to Embodiment 2. In an example of Embodiment 2, the second support members 13 are attached to four first support members 12. Similarly to Embodiment 1, the second support members 13 have main surfaces fixed to the first support members 12 while having the main surfaces extending orthogonal to the X-axis direction. The second support members 13 have the through holes 19 into which the rivets 16 are to be inserted. Similarly to Embodiment 1, two second support members 13 arranged at the both ends in X-axis direction, among the second support members 13 form housing surfaces 10*c* facing each other in the X-axis direction in the housing 2.

Also in Embodiment 2 similar to Embodiment 1, the first exterior members 14*c*, 14*d*, 14*e*, and 14*f* are fixed to the side surfaces of the second support members 13. By arranging the first exterior members 14*c* and 14*e* facing each other, the first exterior members 14*d* and 14*f* facing each other, and the first exterior members 14*e* and 14*f* facing each other around the opening 15, the number of rivets 16 can be reduced compared to the case in which the rivets 16 are arranged in alignment in the longitudinal direction and riveted. As a result, manufacturing cost of the railway vehicle device can be reduced.

As described above, according to the housing 2 of the railway vehicle device of Embodiment 2, the providing of the reinforcing member 11 including the first support member 12 and the second support members 13, as well as at least one of the first exterior members 14*c*, 14*d*, 14*e*, or 14*f* that covers a periphery of the reinforcing member 11 and is fixed to the side surfaces of the second support members 13, enables the manufacturing cost reduction of the railway vehicle device to be reduced. In addition to two housing surfaces 10*b* facing each other in the width direction, a lower housing surface 10*a* in the vertical direction, among two housing surfaces 10*a* facing each other in the vertical direction, can have openings 15, while reducing the manufacturing cost of the railway vehicle device.

Embodiment 3

Figure 9:
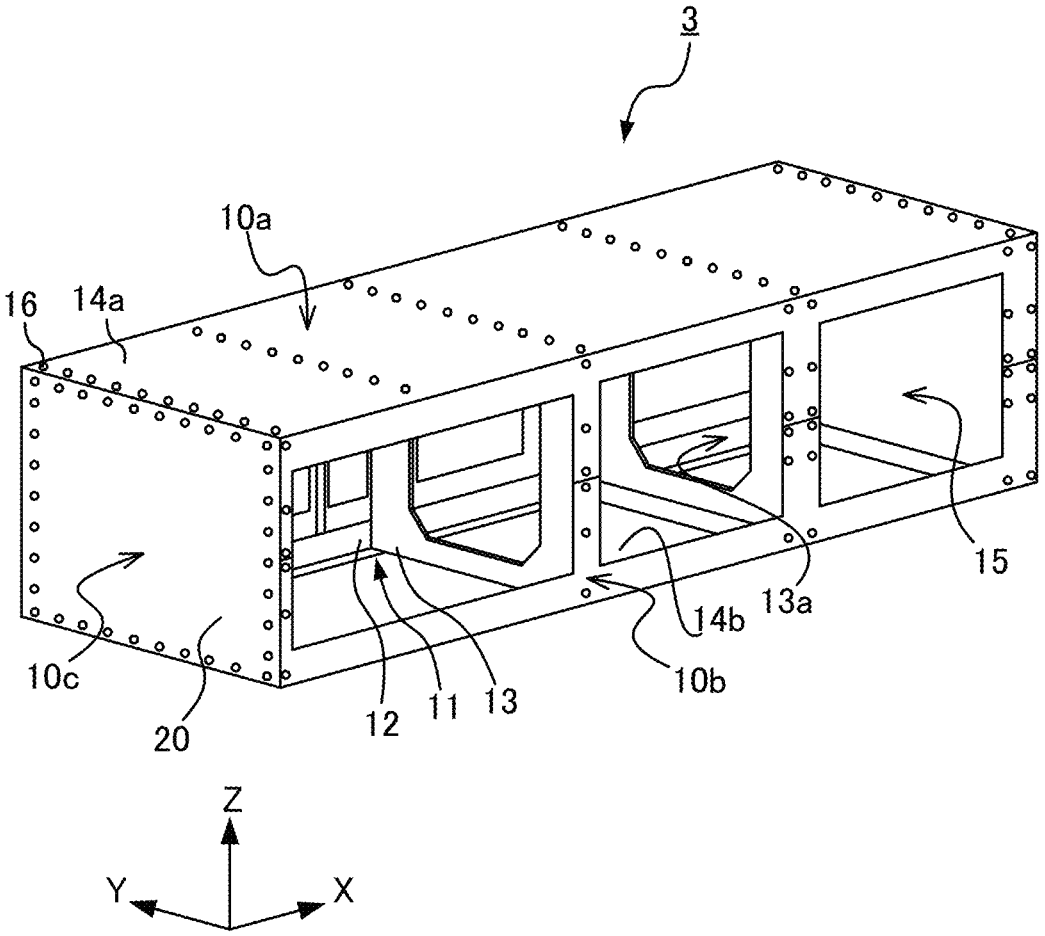
FIG. 9 is a perspective view of a housing of the railway vehicle device according to Embodiment 3 of the present disclosure.
Figure 10:
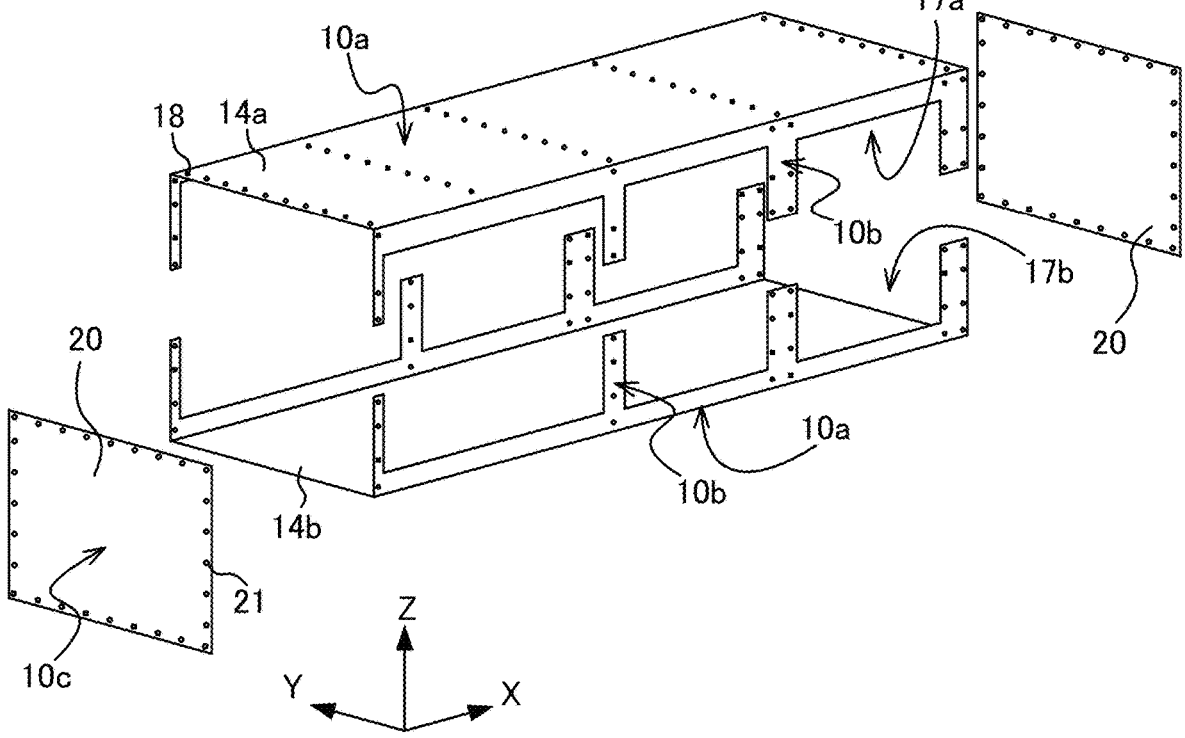
FIG. 10 is a perspective view of first exterior members and second exterior members according to Embodiment 3.

FIG. 9 is a perspective view of a housing of the railway vehicle device according to Embodiment 3 of the present disclosure. A housing 3 according to Embodiment 3 further includes two second exterior members 20 forming two housing surfaces 10*c* facing each other in the X-axis direction. FIG. 10 is a perspective view of first exterior members and second exterior members according to Embodiment 3. The first exterior members 14*a* and 14*b* and two second exterior members 20 form the housing 3. The second exterior members 20 have through holes 21 into which the rivets 16 are inserted.

Figure 11:
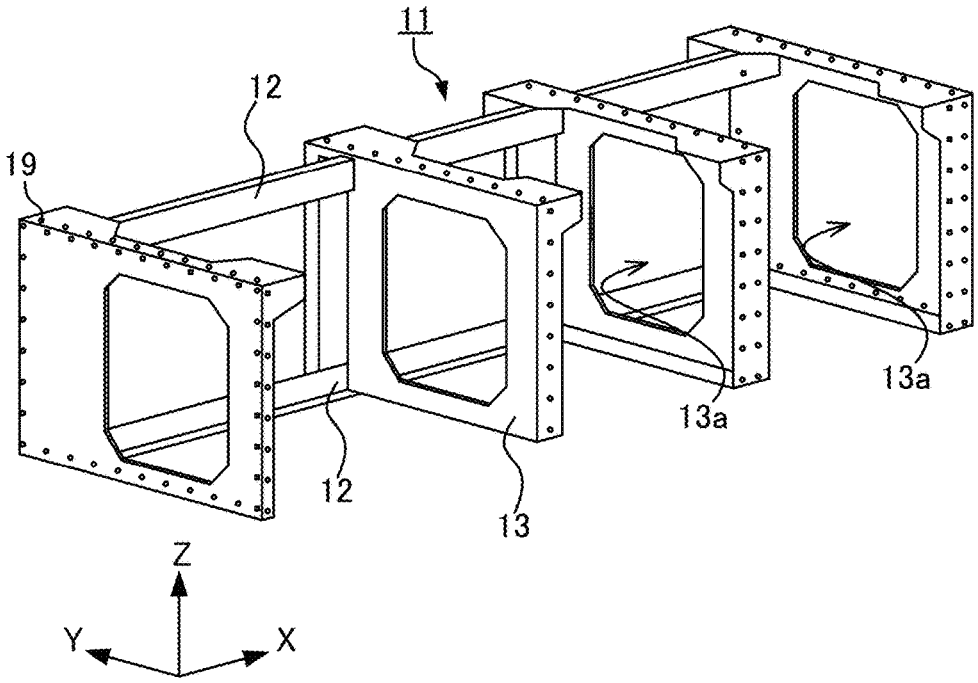
FIG. 11 is a perspective view of a reinforcing member according to Embodiment 3.

FIG. 11 is a perspective view of a reinforcing member according to Embodiment 3. Similarly to Embodiment 1, the second support members 13 are fixed to the first support member 12 while the main surfaces of the second support members 13 are orthogonal to the X-axis direction. The second support members 13 have the through holes 19 into which the rivets 16 are inserted. Similarly to other second support members 13, two second support members 13 arranged at the both ends in the X-axis direction have openings 13*a* penetrating in the X-axis direction, among second support members 13. The second exterior members 20 are attached respectively to the two second support members 13 arranged at the both ends in the X-axis direction. The second exterior members 20 are made of, for example, aluminum for weight reduction of the housing 3. Arrangement of two second support members 13 at the both ends in the X-axis direction that have openings 13*a* enables weight reduction of the housing 3.

As described above, according to the housing 3 of Embodiment 3, weight reduction of the housing 3 can be achieved by providing of the openings 13*a* to the two second support members 13 arranged at the both ends in the X-axis direction and providing, by the second exterior members 20, of two housing surfaces 10*c* facing each other in the X-axis direction.

Embodiments of the present disclosure are not limited to the foregoing embodiments. The foregoing examples may be combined as appropriate. The shapes of the reinforcing member 11, the first exterior members 14*a*, 14*b*, 14*c*, 14*d*. 14*e*, and 14*f*, and the second exterior members 20 can be freely selected. Although the housings 1 and 3 include two first exterior members, that is, the first exterior members 14*a* and 14*b* while the housing 2 includes four first exterior members 14*c*, 14*d*, 14*e*, and 14*f*, the number of first exterior members can be freely selected. In addition, the number of openings 15 can be freely selected.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SIGNS LIST

1, 2, 3 Housing
10*a*, 10*b*, 10*c* Housing surface
11 Reinforcing member
12 First support member
13 Second support member
13*a*, 15 Opening
14*a*, 14*b*, 14*c*, 14*d*, 14*e*, 14*f* First exterior member
16 Rivet

17*a*, 17*b*, 17*c*, 17*d*, 17*e*, 17*f* Cutout
18, 19, 21 Through hole
20 Second exterior member

The invention claimed is:

1. A housing of a railway vehicle device to be attached to a railway vehicle, the housing of the railway vehicle device comprising:

a reinforcing member including a first support member extending in a traveling direction of the railway vehicle, and a plurality of second support members each being a plate member fixed to the first support member and having a main surface oriented in a direction intersecting the traveling direction; and a plurality of first exterior members covering a periphery of the reinforcing member, fixed to side surfaces of the second support members, and forming housing surfaces extending along the traveling direction, and each being a thin plate member, wherein the first exterior members each have a cutout extending in a direction intersecting the traveling direction from at least one end of both ends in the direction intersecting the traveling direction, the cutouts of the first exterior members together form an opening proximate at least one of the housing surfaces extending along the traveling direction, and the first exterior members facing each other are located around the opening.

2. The housing of the railway vehicle device according to claim 1, wherein the first exterior members are two first exterior members each having a rectangular main surface, one of the two first exterior members forms an upper housing surface in a vertical direction, and a part of two housing surfaces facing each other in a width direction orthogonal to the traveling direction and the vertical direction, the another one of the two first exterior members forms a lower housing surface in the vertical direction, and another part of the two housing surfaces facing each other in the width direction, the two first exterior members each have the cutout formed in the both ends, and the two housing surfaces facing each other in the width direction each have the opening due to a formation of the cutout in the two first exterior members.

3. The housing of the railway vehicle device according to claim 1, comprising:

the first exterior members are four first exterior members each having a rectangular main surface, among the four first exterior members, two first exterior members each (i) form a part of an upper housing surface in a vertical direction, (ii) form a part of either one of two housing surfaces facing each other in a width direction that is orthogonal to the traveling direction and the vertical direction, and (iii) have the cutout formed in a lower portion in the vertical direction thereof, among the four first exterior members, the remaining two first exterior members each (i) form a part of a lower housing surface in the vertical direction, (ii) form a part of either one of two housing surfaces facing each other in the width direction, and (iii) have the cutout formed in the both ends thereof, and the lower housing surface in the vertical direction and the two housing surfaces facing each other in the width direction each have the opening formed by the cutout in the four first exterior members.

4. The housing of the railway vehicle device according to claim 1, wherein, among the second support members, two second support members arranged at both ends in the traveling direction form two housing surfaces facing each other in the traveling direction.

5. The housing of the railway vehicle device according to claim 2, wherein, among the second support members, two second support members arranged at both ends in the traveling direction form two housing surfaces facing each other in the traveling direction.

6. The housing of the railway vehicle device according to claim 3, wherein, among the second support members, two second support members arranged at both ends in the traveling direction form two housing surfaces facing each other in the traveling direction.

7. The housing of the railway vehicle device according to claim 1, further comprising:

two second exterior members forming two housing surfaces facing each other in the traveling direction, the two second exterior members each being a thin plate member.

8. The housing of the railway vehicle device according to claim 2, further comprising:

two second exterior members forming two housing surfaces facing each other in the traveling direction, the two second exterior members each being a thin plate member.

9. The housing of the railway vehicle device according to claim 3, further comprising:

two second exterior members forming two housing surfaces facing each other in the traveling direction, the two second exterior members each being a thin plate member.

10. The housing of the railway vehicle device according to claim 1, wherein the first exterior members are fixed to the side surfaces of the second support members by rivets.

11. The housing of the railway vehicle device according to claim 2, wherein the first exterior members are fixed to the side surfaces of the second support members by rivets.

12. The housing of the railway vehicle device according to claim 3, wherein the first exterior members are fixed to the side surfaces of the second support members by rivets.

13. The housing of the railway vehicle device according to claim 1, wherein the reinforcing member is made of iron.

14. The housing of the railway vehicle device according to claim 2, wherein the reinforcing member is made of iron.

15. The housing of the railway vehicle device according to claim 3, wherein the reinforcing member is made of iron.

16. The housing of the railway vehicle device according to claim 1, wherein the first exterior members are made of aluminum.

17. The housing of the railway vehicle device according to claim 2, wherein the first exterior members are made of aluminum.

18. The housing of the railway vehicle device according to claim 3, wherein the first exterior members are made of aluminum.

19. The housing of the railway vehicle device according to claim 7, wherein the second exterior members are made of aluminum.

20. The housing of the railway vehicle device according to claim 8, wherein the second exterior members are made of aluminum.

* * * * *